US005584182A

United States Patent [19]

Althaus et al.

[11] Patent Number: 5,584,182

[45] Date of Patent: Dec. 17, 1996

[54] COMBUSTION CHAMBER WITH PREMIXING BURNER AND JET PROPELLENT EXHAUST GAS RECIRCULATION

[75] Inventors: Rolf Althaus, Kobe, Japan; Jakob Keller, Redmond, Wash.

[73] Assignee: ABB Management AG, Baden, Switzerland

[21] Appl. No.: 408,491

[22] Filed: Mar. 22, 1995

[30] Foreign Application Priority Data

Apr. 2, 1994 [DE] Germany ..... 44 11 624.1

[51] Int. Cl.[6] ..... F02C 1/00

[52] U.S. Cl. ..... 60/737; 60/750; 60/39.25; 431/116

[58] Field of Search ..... 60/39.52, 737, 60/748, 750; 431/115, 116, 9

[56] References Cited

U.S. PATENT DOCUMENTS

| | | | |
|---|---|---|---|
| 3,097,686 | 7/1963 | Morrow | 431/115 |
| 3,323,304 | 6/1967 | Llobet et al. | 60/39.52 |
| 3,851,467 | 12/1974 | Sherman et al. | 431/116 |
| 3,927,958 | 12/1975 | Quinn | 60/750 |
| 4,351,156 | 9/1982 | White et al. | 60/737 |
| 4,356,698 | 11/1982 | Chamberlain | 60/737 |
| 4,613,299 | 9/1986 | Backheim | 60/39.52 |
| 4,708,638 | 11/1987 | Brazier et al. | 431/116 |
| 5,044,935 | 9/1991 | Peter | 431/115 |
| 5,081,844 | 1/1992 | Keller et al. | 60/737 |
| 5,135,387 | 8/1992 | Martin et al. | 431/116 |
| 5,154,059 | 10/1992 | Keller | 60/737 |
| 5,412,938 | 5/1995 | Keller | 60/39.52 |

FOREIGN PATENT DOCUMENTS

| | | | |
|---|---|---|---|
| 1590843 | 9/1990 | U.S.S.R. | 431/116 |

*Primary Examiner*—Timothy Thorpe
*Assistant Examiner*—Ted Kim
*Attorney, Agent, or Firm*—Burns, Doane, Swecker & Mathis, L.L.P.

[57] ABSTRACT

In the combustion chamber of a gas turbine, at least one premixing burner (110) is arranged in a dome (51) communicating with a plenum (50). Said premixing burner (110) is fastened on the outlet side to a front plate (52) limiting the combustion space (58) of the combustion chamber. The premixing burner procures the combustion air from the dome. The fuel injected via nozzles is intensively intermixed with the combustion air within a premixing space of the burner prior to ignition.

There is provided a jet injector (53) which opens into the dome (51) and of which the central nozzle (54) is connected to the combustion space (58) via an orifice (55) in the front plate (52) and of which the annular space (56) surrounding the central nozzle is loaded with a propellant.

1 Claim, 1 Drawing Sheet

COMBUSTION CHAMBER WITH PREMIXING BURNER AND JET PROPELLENT EXHAUST GAS RECIRCULATION

BACKGROUND OF THE INVENTION

1. Field of the Invention

The invention relates to a combustion chamber, for example for a gas turbine, with at least one premixing burner which is arranged in a dome communicating with a plenum and which is fastened on the outlet side to a front plate limiting the combustion space of the combustion chamber.

In such a premixing burner the combustion air is supplied from the dome, and fuel is injected via nozzles intensively intermixed with the combustion air within a premixing space prior to ignition.

2. Discussion of Background

Combustion with the highest possible excess air number (which is defined as the ratio of the actual air/fuel ratio to the stoichiometric air/fuel ratio), is generally determined, on the one hand, by the fact that the flame still burns at all and, further, by the fact that too much CO does not occur. Combustion of this type reduces not only the quantity of harmful $NO_x$, but, moreover, also ensures that other harmful substances are kept low, in particular, as already mentioned, CO and unburnt hydrocarbons. This makes it possible to select a higher excess air. In addition, although larger quantities of CO occur initially, these can nevertheless react further to form $CO_2$, so that, finally, the CO emissions remain low. On the other hand, however, only little additional $NO_x$ forms on account of the high excess air. Since a plurality of tubular elements accomplish the premixing in this known combustion chamber, during load regulation only as many elements are in each case operated with sufficient fuel to ensure that the optimum excess air number is obtained for the particular operating phase (starting, part load, full load).

The so-called premixing burners of the double-cone design can be designated as flame-holding burners of the type mentioned at the outset. Such double-cone burners are known, for example, from U.S. Pat. No. 4,932,861 to Keller et al and will be described later with reference to FIGS. 1 and 2. The fuel, gas there, is injected in the inlet gaps into the combustion air flowing forwards from the compressor, by way of a row of injector nozzles. These are usually distributed uniformly over the entire gap.

In order to achieve a reliable ignition of the mixture in the downstream combustion chamber and a sufficient burn-up, an intimate mixing of the fuel with the air is necessary. Good intermixing also contributes to avoiding so-called "hot spots" in the combustion chamber, which lead inter alia, to the formation of the undesirable $NO_x$.

However, all combustion chambers with premixing burners have a shortcoming that the limit of flame stability is nearly reached, at least in the operating states in which only some of the burners are operated with fuel, or in which the individual burners are loaded with a reduced quantity of fuel. In fact, on account of the very lean mixture and the low flame temperature resulting from this, under typical gas-turbine conditions the extinguishing limit is already reached when the excess air number is approximately 2.0.

This fact leads to a relatively complicated mode of operation of the combustion chamber with a regulation which involves a correspondingly high outlay. Another possibility for widening the operating range of premixing burners is seen in assisting the burner by means of a small diffusion flame. The fuel which this pilot flame receives is pure or at least inadequately premixed, thus on the one hand leading admittedly to a stable flame, but on the other hand resulting in the high $NO_x$ emissions typical of diffusion combustion.

SUMMARY OF THE INVENTION

The invention attempts to avoid all these disadvantages. The object on which it is based is to provide a measure, by means of which the combustion chamber can be operated as near as possible to the lean extinguishing limit, that is in that range in which virtually no $NO_x$ occurs.

This is achieved, according to the invention, in that there is provided at least one jet injector which opens into the dome. The jet injector has a central nozzle connected to the combustion space via an orifice in the front plate and an annular space surrounding the central nozzle loaded with a working medium, the pressure of which is higher than the pressure in the dome.

With this exhaust-gas return, by means of which the burner is operated at a higher inlet temperature, the operating range of a premixing burner can be widened considerably. Lower $NO_x$ values are achieved as a result of the low primary temperatures attainable.

Because the burners remain operative when the mixture is very lean, regulation can be simplified. It as it is now possible, when the combustion chamber is being subjected to load and relieved of load, to pass through fuel/air ratio ranges which it would, as a rule, have been impossible to pass through with the previous premixing combustion.

The new measure, which guarantees a mode of operation near the extinguishing limit in the predominant operating range, ensures that it is reliably possible to fall considerably below the $NO_x$ values of 20 ppm obtainable today.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein an exemplary embodiment of the invention is shown diagrammatically with reference to a premixing burner of the double-cone design and wherein.

Only the elements essential for understanding the invention are shown. For example, the complete combustion chamber and its assignment to a plant, the fuel preparation, the regulating devices and the like are not illustrated. The direction of flow of the working media is designated by arrows.

DESCRIPTION OF THE PREFERRED EMBODIMENT

Figure 1:
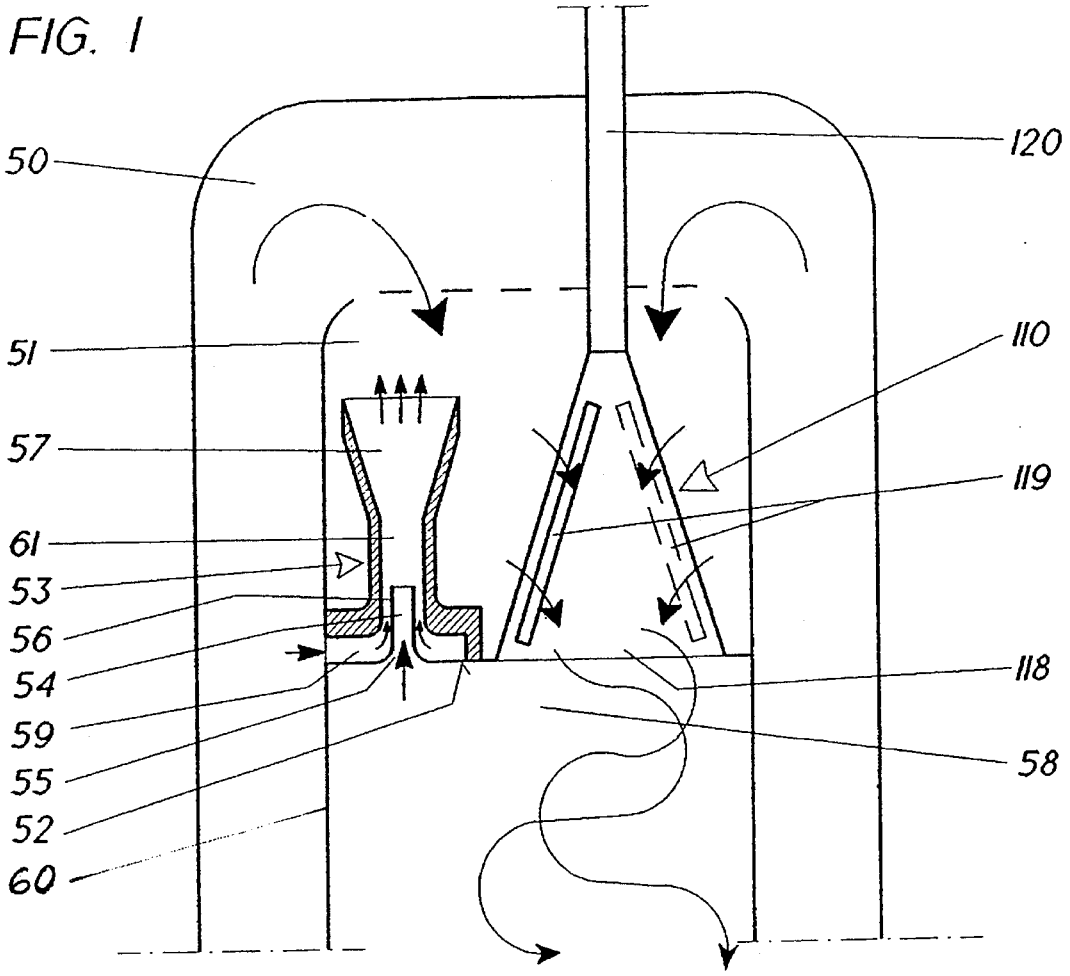
FIG. 1 shows a part longitudinal section through a combustion chamber.
Figure 2A:
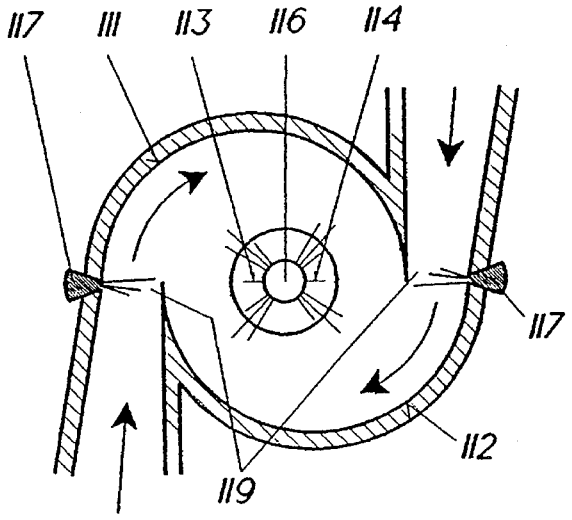
FIG. 2A shows a cross section through a premixing burner of the double-cone design in the region of its outlet.
Figure 2B:
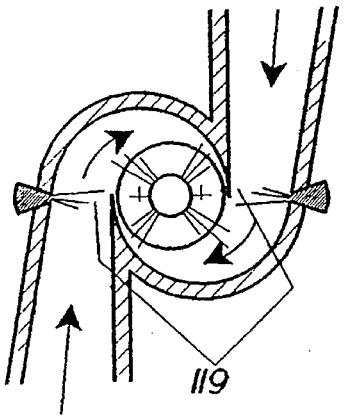
FIG. 2B shows a cross section through the same premixing burner in the region of the cone apex.

Referring now to the drawings, wherein like reference numerals designate identical or corresponding parts throughout the several views, in FIG. 1, 50 denotes an encased plenum which, as a rule, receives the combustion air conveyed from a compressor (not shown) and feeds it to a combustion chamber 60. A dome 51 is placed onto the combustion chamber, the combustion space 58 of which is limited by a front plate 52. A burner 110 is arranged in this dome in such a way that the burner outlet is at least approximately flush with the front plate 52. The combustion chamber can be either an annular combustion chamber or a cylindrical silo-type combustion chamber. The instance illustrated is that of an annular combustion chamber, which means that a multiplicity of burners 110 are arranged next to one another on the annular front plate 52 in a manner distributed over the circumference and offset uniformly or relative to one another. The combustion air flows out of the plenum 50 into the dome interior via the dome wall perforated at its outer end and loads the burners. The fuel is fed to the burner via a fuel lance 120 which passes through the wall of the dome and of the plenum.

The diagrammatically illustrated premixing burner 110 is a so-called double-cone burner, such as is known, for example, from U.S. Pat. No. 4,932,861 to Keller et al. It consists essentially of two hollow conical part bodies 111, 112 which are nested one into the other in the direction of flow. At the same time, the respective mid-axes 113, 114 of the two part bodies are offset relative to one another. The adjacent walls of the two part bodies form, in their longitudinal extension, tangential slots 119 for the combustion air which thereby passes into the burner interior. A first fuel nozzle 116 for liquid fuel is arranged in the burner interior. The fuel is sprayed into the hollow cones at an acute angle. The conical fuel profile obtained is surrounded by the combustion air flowing in tangentially. In the axial direction, the concentration of the fuel is continuously reduced as a result of intermixing with the combustion air. In the example, the burner is also operated with gaseous fuel. For this purpose, gas-inflow orifices 117 distributed in the longitudinal direction in the walls of the two part bodies are provided in the region of the tangential slots 119. In gas operation, the formation of the mixture with the combustion air thus already commences in the zone of the inlet slots 119. It goes without saying that mixed operation with both types of fuel is also possible thereby.

As homogeneous a fuel concentration as possible is established over the loaded annular cross section at the burner outlet 118. A specific cap-shaped backflow zone, at the tip of which ignition takes place, occurs at the burner outlet. Double-cone burners are thus far known from U.S. Pat. No. 4,932,861 to Keller et al mentioned at the outset.

The states in such a combustion chamber can, for example, be as follows. Pressure of the combustion air in the plenum=14 bar; pressure of the combustion air in the dome=13.5 bar; temperature of the combustion air in the dome=400° C.; temperature of the hot gases in the combustion space=1400° C.

According to the invention, by means of an exhaust-gas return the temperature of the combustion air upstream of the burner is increased to 600° C. Provided for this purpose is a jet injector 53 which opens into the dome 51 and which is suitably connected to the front plate 52.

The central nozzle 54 of the jet injector communicates with the combustion space 58 via an orifice 55 in the front plate 52. This orifice 55 is located in a free space on the front plate 52, which free space can be both radially next to the burner 110 or offset in the circumferential direction thereof.

The annular space 56 of the jet injector surrounding the central nozzle 54, is loaded with a propellant which, in the present instance, is extracted from the plenum 50. This is therefore combustion air, the pressure of which is not appreciably above that within the dome 51. For this purpose, the annular space 56 is connected to the plenum via an annular chamber 59.

The central nozzle 54 and the annular space 56 open into a impulse-exchange space 61 which is followed by a diffuser 57 for the purpose of pressure recovery. If the diffuser is designed, for example, for an outlet velocity of approximately 40 m/sec and has a pressure-recovery factor of approximately 0.7, then it can be seen that the propellant can have a pressure lower than the dome pressure at the inlet into the jet injector. Another working medium, for example cooling air, can therefore also be used as a propellant of the jet injector. It goes without saying that the jet injector itself causes a considerable pressure drop, and therefore the dimensioning of its nozzle surfaces can be carried out only in conjunction with the burner used and its pressure drop.

The invention is, of course, not restricted to the example described and shown. Thus, in contrast to the double-cone burner illustrated, any premixing burner can be employed.

Obviously, numerous modifications and variations of the present invention are possible in light of the above teachings. It is therefore to be understood that, within the scope of the appended claims, the invention may be practiced otherwise than as specifically described herein.

What is claimed as new and desired to be secured by Letters Patent of the United States is:

1. A combustion chamber for a gas turbine, having a plenum and a dome defining a dome space for guiding compressed combustion air, air flow proceeding from the plenum to the dome space, and comprising:

a front plate bounding the combustion space at a front end of the combustion chamber and separating the combustion space from said dome space, the combustion space and dome space being surrounded by an enclosed plenum;

at least one premixing burner mounted with an outlet end at the front plate, the burner including two conical section bodies mounted to define a conical interior, the bodies being mutually positioned to form longitudinal inlet openings for a tangentially directed flow of combustion air into the interior, the inlet openings communicating with the dome space to receive combustion air, and fuel injectors positioned at longitudinal edges of the bodies and directed to inject fuel into the longitudinal inlet openings, wherein fuel and combustion air is mixed and burned in the interior before passing through the outlet end; and, at least one jet injector connected to an orifice on the front plate, the jet injector having a central nozzle directed to deliver high temperature gas from the combustion space to the dome space to preheat the combustion air, the nozzle including an outlet diffuser, and the jet injector having an annular space surrounding the central nozzle and connected to the plenum for supplying combustion air as a propellant to the annular space.

* * * * *